US010982457B2

(12) United States Patent
Resh

(10) Patent No.: US 10,982,457 B2
(45) Date of Patent: Apr. 20, 2021

(54) VACUUM HEAD AND HOSE APPARATUS AND RELATED METHODS

(71) Applicant: Eric V. Resh, Temecula, CA (US)

(72) Inventor: Eric V. Resh, Temecula, CA (US)

(73) Assignee: RESH, INC., Murrieta, CA (US)

( * ) Notice: Subject to any disclaimer, the term of this patent is extended or adjusted under 35 U.S.C. 154(b) by 262 days.

(21) Appl. No.: 16/162,208

(22) Filed: Oct. 16, 2018

(65) Prior Publication Data

US 2019/0048606 A1 Feb. 14, 2019

Related U.S. Application Data

(63) Continuation of application No. 14/215,522, filed on Mar. 17, 2014, now Pat. No. 10,100,545.

(60) Provisional application No. 61/800,662, filed on Mar. 15, 2013.

(51) Int. Cl.
*E04H 4/16* (2006.01)

(52) U.S. Cl.
CPC ..... *E04H 4/169* (2013.01); *E04H 4/1636* (2013.01); *E04H 4/1645* (2013.01)

(58) Field of Classification Search
CPC ..... E04H 4/1636; E04H 4/1645; E04H 4/169
See application file for complete search history.

(56) References Cited

U.S. PATENT DOCUMENTS 1,476,119 A * 12/1923 Van Nagell ..... F16L 37/248 285/148.13
3,509,589 A * 5/1970 Bond ..... E04H 4/1636 15/1.7
4,240,174 A * 12/1980 Thiem ..... A47L 9/02 15/1.7
4,254,525 A * 3/1981 Combest ..... E04H 4/1636 15/1.7
4,835,810 A * 6/1989 Hugo ..... E04H 4/1636 15/1.7
5,033,149 A * 7/1991 Russo ..... E04H 4/1636 15/1.7
5,079,796 A * 1/1992 Berfield ..... A47L 9/02 15/415.1
5,082,028 A * 1/1992 Leonard ..... E04H 4/1645 138/103
5,352,358 A * 10/1994 Davey ..... E04H 4/1636 210/167.15
5,799,351 A * 9/1998 Rief ..... E04H 4/1663 15/1.7
5,897,083 A * 4/1999 Johnson ..... B60R 15/04 138/109

(Continued)

FOREIGN PATENT DOCUMENTS

EP 1234932 A2 * 8/2002 ..... E04H 4/1636
WO WO-0073691 A1 * 12/2000 ..... E04H 4/1636

*Primary Examiner* — Marc Carlson
(74) *Attorney, Agent, or Firm* — J. Mark Holland + Associates; J. Mark Holland; Alison L. Adnan

(57) ABSTRACT

Methods and apparatus are disclosed for an improved underwater vacuum cleaning system. Urging elements are provided on a vacuum head to encourage debris, especially large pieces of underwater debris, to matriculate under the head or otherwise toward the vacuum opening, rather than traveling over the head or otherwise NOT toward the vacuum opening. Various embodiments of engagement elements are disclosed between the vacuum head and a vacuum hose to improve the connection therebetween.

35 Claims, 6 Drawing Sheets

(56) References Cited

U.S. PATENT DOCUMENTS

| | | | | |
|---|---|---|---|---|
| D593,186 | S * | 5/2009 | van der Meijden | D23/266 |
| D634,406 | S * | 3/2011 | Klimas | D23/262 |
| 8,375,497 | B1 * | 2/2013 | Fitzen | E04H 4/1636 15/1.7 |
| 2009/0007349 | A1 * | 1/2009 | Bauckman | E04H 4/1663 15/1.7 |
| 2010/0122949 | A1 * | 5/2010 | Van Der Meijden | E04H 4/1609 210/167.19 |
| 2011/0179590 | A1 * | 7/2011 | Klimas | E04H 4/1672 15/1.7 |
| 2014/0259467 | A1 * | 9/2014 | Resh | E04H 4/1636 15/1.7 |
| 2019/0048606 | A1 * | 2/2019 | Resh | E04H 4/169 |

* cited by examiner

VACUUM HEAD AND HOSE APPARATUS AND RELATED METHODS

This application is based on and claims priority to U.S. provisional application Ser. No. 61/800,662, filed Mar. 15, 2013.

This invention relates broadly to devices for underwater cleaning of manmade, lined bodies of water such as fish ponds, fountains, water features, swimming pools, and similar things. More specifically, it is directed to apparatus and methods involving an improved vacuum useful for (among other things) cleaning a swimming pool. As indicated herein, the inventions disclosed herein can be used in a broad range of applications and provide many benefits.

The present invention is described herein with reference to the accompanying Figures, which serve as illustrations of some of the many embodiments in which the invention may be practiced. Subject to the context and other factors (including for example the understanding of persons of ordinary skill in the arts relevant to the inventions), generally in those Figures and references similar reference numerals refer to similar or identical elements throughout this description.

Those Figures and references, and the other terminology used in these descriptions, are not intended to be interpreted in any limited or restrictive manner, simply because they are being utilized in conjunction with a detailed description of certain embodiments of the invention. Furthermore, various embodiments of the invention (whether or not specifically described herein) may include one or more of the novel features disclosed herein, no single one of which (a) is necessarily solely responsible for any particular desirable attribute(s) of the inventions or (b) is essential to practicing the inventions described.

For the purpose of summarizing the invention certain objects and advantages have been described herein. It is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

These and other embodiments will become readily apparent to those skilled in the art from the following detailed description of the preferred embodiments having reference to the attached figures, the invention not being limited to any particular preferred embodiment(s) disclosed.

BACKGROUND OF THE INVENTION

Many prior art underwater vacuums used for cleaning swimming pools consist of two components designed to be used together, namely, the vacuum head and vacuum hose. Pool vacuum heads tend to have a body element rectangular in shape and have a central hole formed to receive a vacuum hose; the heads are often made of flexible plastic, fitted with wheels (though some use brushes), and have a handle that can be attached to a telescopic pole to enable a user to manipulate the head and vacuum the bottom (underwater surfaces) of a pool while standing above the pool on the pool deck.

A flexible and generally water tight vacuum hose with a cuff mounted on each end is generally used with the vacuum head. The hose cuffs are designed to serve as both male and female attachments; their generally cylindrical shapes have inside dimensions sized to fit snugly over many male vacuum connectors, and their outside dimensions fit snugly within many female connectors. When in use for cleaning a swimming pool, the hose typically connects a source of vacuum to the vacuum head to provide the desired vacuum action as the head moves across the pool's underwater surfaces. Typically, one cuffed hose end is connected to the vacuum head's central hole (using either the male or female connection, based on what fitting is present on the vacuum head), and the other cuffed hose end is connected to suction plumbing (again with either a male or female connection) that is located either in the pool skimmer or a similar plumbing feature. The vacuum force within the hose tends to pull the head into tighter engagement with the hose, but as described herein, that "vacuum/friction fit" connection is less than satisfactory in many situations.

The overall combination of vacuum head, vacuum hose and attached telescopic pole enable a user to maneuver the vacuum head around the pool to remove dirt, leaves and other sorts of debris from the pool. The vacuum pulls the targeted debris under the typically rectangular body element of the vacuum head, through the vacuum head's central hole, through the hose, and then through the suction plumbing (to be filtered or otherwise disposed of, such as by straining it through baskets and/or other filters). This process thus draws the dirt, leaves, etc. out of the pool and removes it from the pool water.

Some problems with swimming pool vacuums and hoses of prior art, however, are associated with the failure of the vacuum head to effectively 'pick up' debris such as leaves, twigs, etc. from the pool bottom. In order for vacuum heads to effectively maintain suction suitable for cleaning, the head typically must relatively closely confront the swimming pool's surface that is being cleaned. Among other things, this relatively close proximity ensures that the debris is within the effective scope of the vacuum power. When used as intended, the heads thus have suction around their edges (the edges that are on or adjacent the surface being cleaned), much like a carpet vacuum operates in a home.

Wheeled vacuum heads can involve performance tradeoffs. The wheels are often positioned in such a way that the vacuum head sits some quarter inch or so above the surface being cleaned. Although this permits small debris to easily be drawn under the vacuum head's housing, it is not uncommon for the vacuum head to be so low (or so close to the surface being cleaned) that the head passes under large debris such as leaves or twigs, failing to remove them from the pool. In some instances, such large debris is even pushed away or otherwise moved by the vacuum head (without being sucked into the vacuum), resulting in a further failure to effectively clean the swimming pool or water feature.

Another common problem with prior art systems occurs with the connection between the vacuum head and hose. As indicated above, typically the connection involves a male/female mating fitting. Due to a number of factors, the snugness of that fitting (and the resulting effectiveness of transmission of the vacuum pull through that male/female joint) can deteriorate over time (or may even be deficient from its first use). Among other things, mating parts can be damaged or worn down after repeated use, especially in view of the environments in which they are used (commonly outdoors, with extreme sun exposure that itself can damage the integrity of the typically plastic male/female fittings), and in view of the lack of careful handling that is common by persons operating the equipment. Even if the fittings are made from metal or a combination of materials, such damage and/or wear and tear can occur (and can negatively affect the quality of the male/female fit). These issues can occur on both or either end of the hose (and the related corresponding fitting), and can occur regardless of the orientation and/or position of the male versus the female fitting.

Other factors and usages/actions can similarly damage the quality of the hose/head joint. For example, some suction plumbing connections (such as pool skimmers and/or similar hookups) are located in areas that are relatively distant from parts of the pool that need cleaning. In such situations, a user sometimes must 'stretch' the hose to (or even beyond) its normal limits in order to vacuum one or more of those distant portions of the pool. Sometimes this stretching can cause the connection between the vacuum head and hose to fail (such as becoming disconnected). If the failure occurs while the hose is in the pool water and before actual vacuuming begins, the hose (having a natural tendency to float and coil) will tend to drift away from the vacuum head, and the user will be forced to retrieve the hose end, reconnect it to the vacuum head, and start the "stretching" again. If the hose separates from the head during vacuuming, the internal suction action in the hose will cause the hose almost immediately to float to the pool's surface, where the end of the hose commonly breaches the surface and sucks air into the vacuum plumbing. This air intake sometimes causes the pool pump to lose prime, so that not only will the user need to start the entire process again (see above), but he/she will also have the additional burden of priming the pump.

Furthermore, many pool owners and professionals find it convenient to keep the vacuum head and hose connected when they are not in use. Doing so can make transporting the hose/head assemblies easier, especially if the hose is coiled around the vacuum head and bound with a bungee cord or strap. However, accidental separation at the male/female joint can and does occur while such assemblies are being carried. In addition to being generally irritating, such separations also result in the inconvenience or even danger of the user having to catch and/or pick up falling/fallen pieces when the user's hands are already full from carrying the vacuum hose and vacuum head. Such situations may even lead to minor injury of the user's feet (since people are often barefooted when around swimming pools) or of other persons who may happen to be in the vicinity.

BRIEF DESCRIPTION OF THE DRAWINGS

FIG. 7 shows the male hose cuff of FIG. 6 as the upper element in FIG. 7, as it may be attached to or engaged with a female opening on the vacuum head (the female element being shown as the lower element in FIG. 7). The cuff includes a movable detent element with material memory that urges it radially outwardly to engage an inside edge of the female component. Preferably, the head/hose can be disengaged from each other as needed by squeezing that movable detent/lever radially inwardly, so that the hose/cuff structure can be removed (such as in the upward direction) from the lower female component of the vacuum head.

DETAILED DESCRIPTION OF EMBODIMENTS

Figure 1:
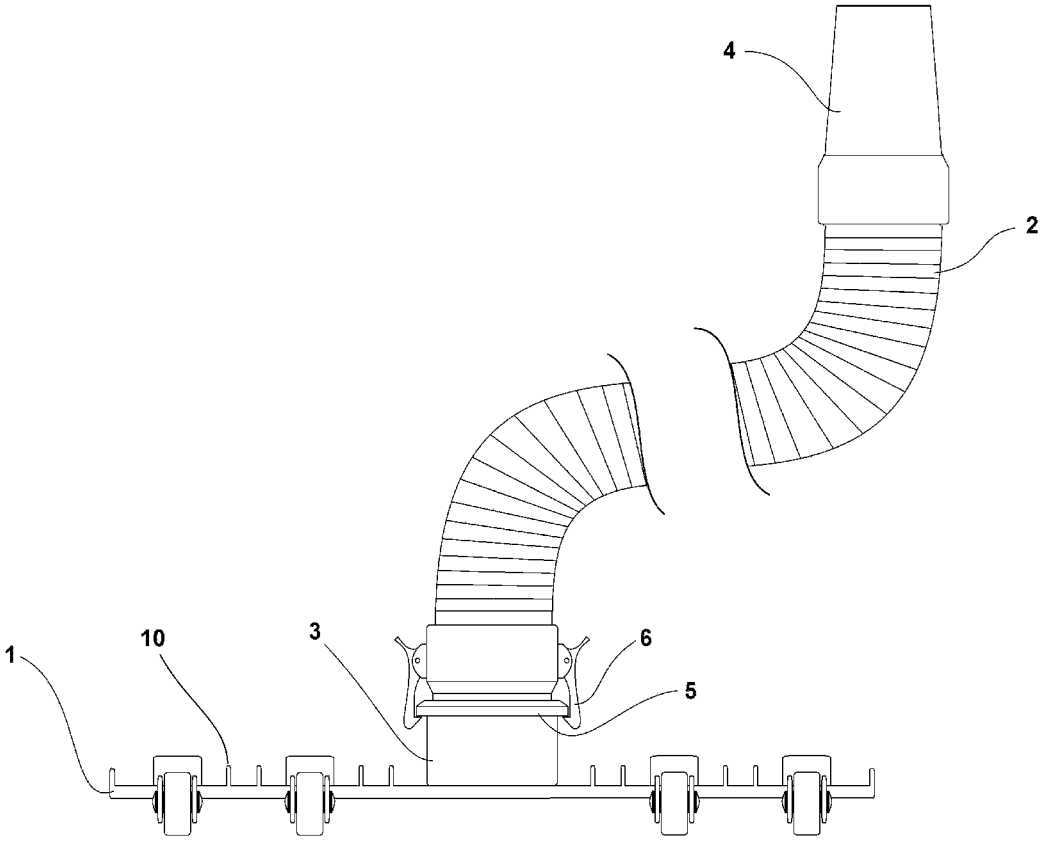
FIG. 1 is a foreshortened elevation view of one embodiment of the invention, showing the assembled interlocking device engaging a hose 2 with a vacuum head 1.

As indicated above, the inventions disclosed herein can be used in a broad range of applications and provide many benefits. One object of my invention is to provide an improved apparatus and methods for vacuum-cleaning the underwater surfaces of swimming pools or similar bodies of water. FIG. 1 illustrates one of the many embodiments of the invention, and includes the two basic components discussed above (a vacuum head 1 and a vacuum hose 2). As further explained below, FIG. 1 and the other drawings illustrate just some of the many embodiments of using a vacuum head with flares and/or an interlocking hose/head to improve the apparatus and methods over the prior art vacuum systems of which the inventor is aware.

In passing, FIG. 1 also shows a series of reinforcing ribs integrally formed into the vacuum head 1 and running across the upper surface of the body of the vacuum head. These small upward protrusions or ridges 10 are present in some prior art vacuum heads, and typically are positioned between the wheels on the vacuum head and extend the width of the vacuum head (FIG. 1 shows the "ends" of the ribs). Among other things, they enable the body of the vacuum head to be formed from a thinner web of plastic or other material (and therefore make the head more lightweight), because the ribs help strengthen the resulting thinner broad/flat/rectangular body of the vacuum head so that it does not flex too greatly when vacuuming. Persons of ordinary skill in the art will understand that, without such stiffening elements, the body of the vacuum head might get sucked onto (and even stuck or locked against) the bottom of the pool. In other words, for a given/desired vacuum strength (to provide sufficiently strong suction to pull the debris from the underwater surface being cleaned), the ribs can ensure that the body of the head stays spaced at least slightly from the underwater pool surface to prevent that vacuum force from locking the head against that pool surface.

Figure 1A:
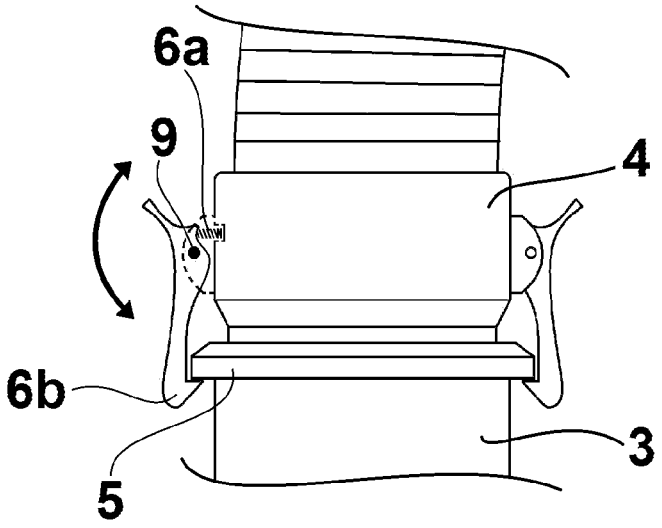
FIG. 1A is an enlarged, sectional view of some of the interlocking assembly details of the embodiment of FIG. 1, showing one of the many embodiments of spring-loaded clips selectably holding the hose and vacuum head assembled to each other.
Figure 1B:
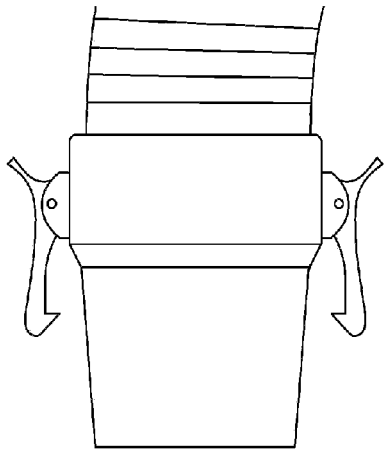
FIG. 1B is similar to FIG. 1A, but shows only the upper cuff structure, as viewed when disengaged and separated from the mating structure on the vacuum head. Persons of ordinary skill in the art will understand that, in other embodiments (not shown) the joint illustrated in the embodiments of FIGS. 1/1A/1B could be reversed (e.g., the clip elements can be provided on the head rather than on the hose cuff, and the structure shown on the head in FIGS. 1/1A/1B formed or provided on the hose cuff).
Figure 2:
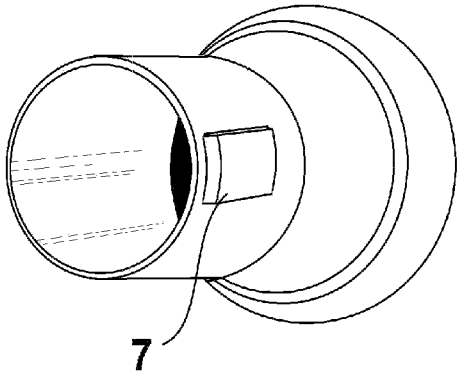
FIG. 2 illustrates one of the many embodiments of an interlocking structure 5 on a vacuum hose cuff.
Figure 3:
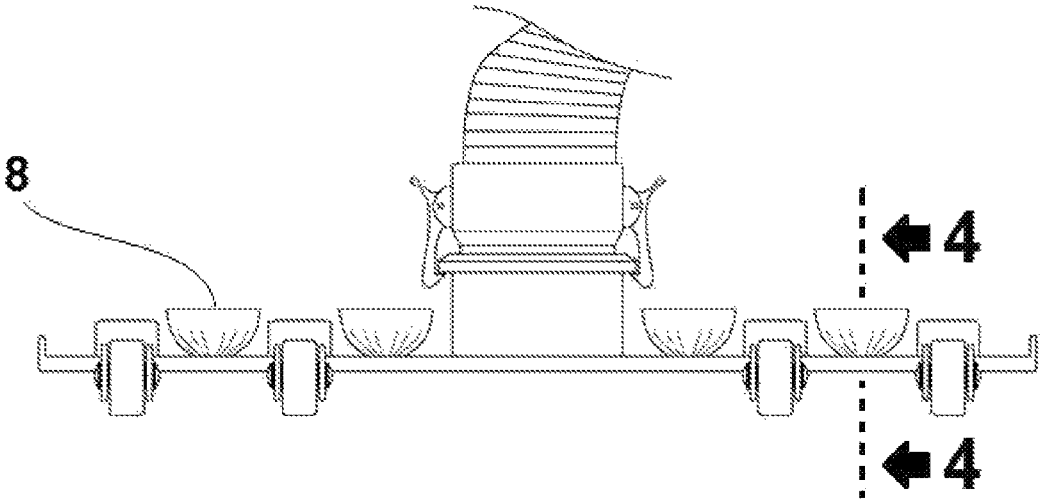
FIG. 3 is a side elevation view of another of the many embodiments of the invention, including a plurality of flared urging components 8.
Figure 4:
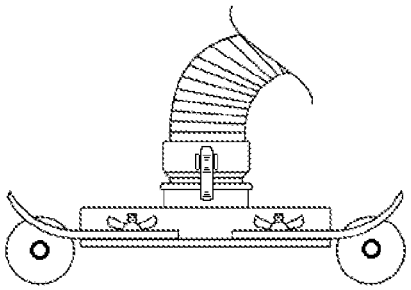
FIG. 4 is similar to FIG. 3, but is an end view taken along line 4-4 of FIG. 3.
Figure 5:
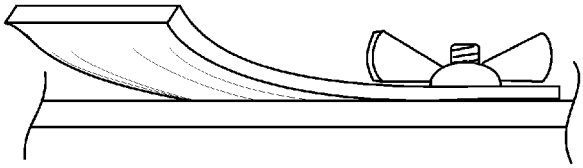
FIG. 5 is a foreshortened perspective view of one of the flare/urging elements shown in FIGS. 3 and 4, as it may be removably attached to the head via a wingnut-type assembly.
Figure 6:
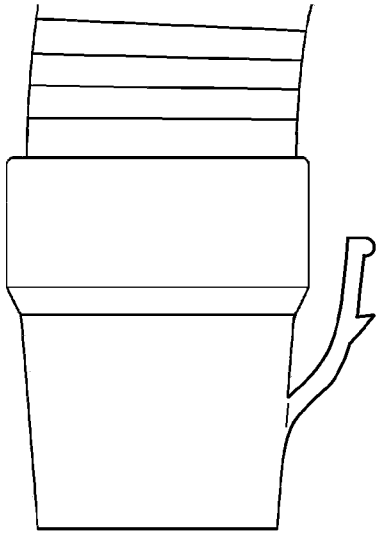
FIG. 6 illustrates one of the many alternative engagement hose cuff structures that may be used to provide the desired releasable engagement between a mating hose cuff and vacuum hole/head element.
Figure 7:
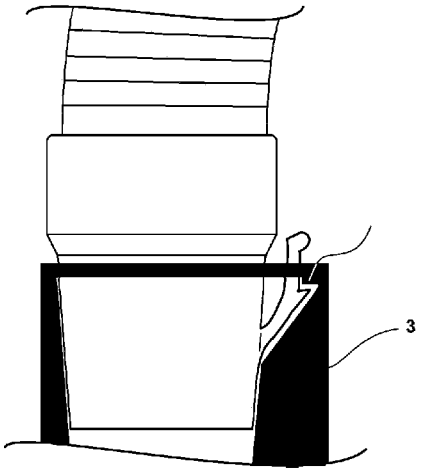
FIG. 7 is similar to FIG. 6, but is a partial cutaway drawing showing one of the many embodiments of the cuff of FIG. 6 as it might be engaged with a corresponding/mating element on the other of the head/hose joint. In this view, the female element 3 on the vacuum head is shown in solid black (with a central area of element 3 removed as a "cutaway" to show the preferred "internal" engagement between the joint elements). Among other things.
Figure 8:
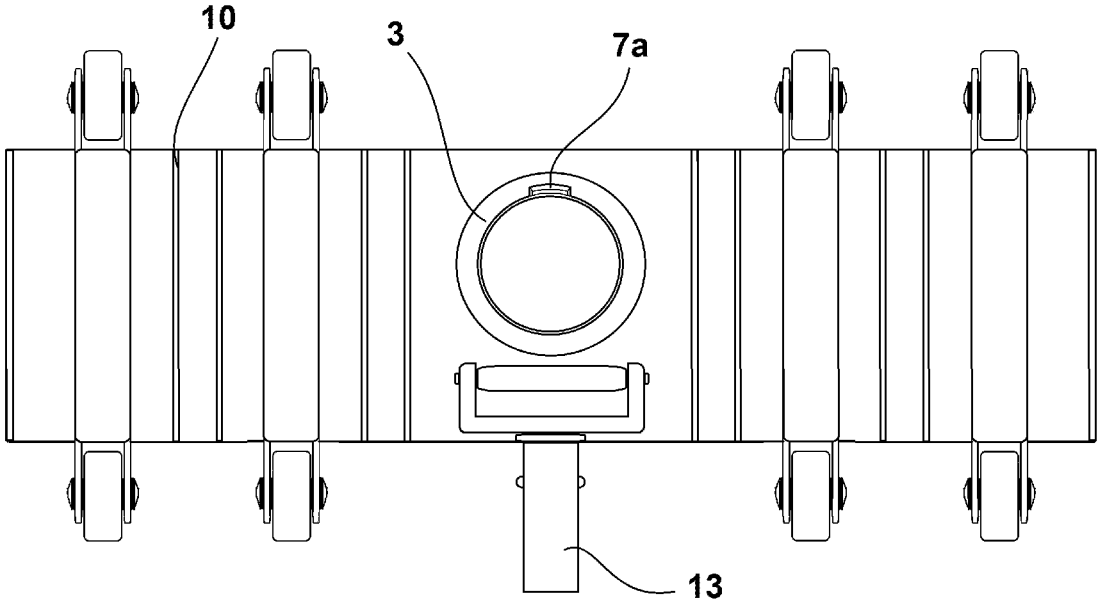
FIG. 8 is a top view of a vacuum head in accordance with the invention. Among other things, this view illustrates the reinforcing ridges 10 across the vacuum head, and a cavity 7*a* sized and configured to engage with the hose cuff interlocking structure 7 in FIG. 2.
Figure 9A:
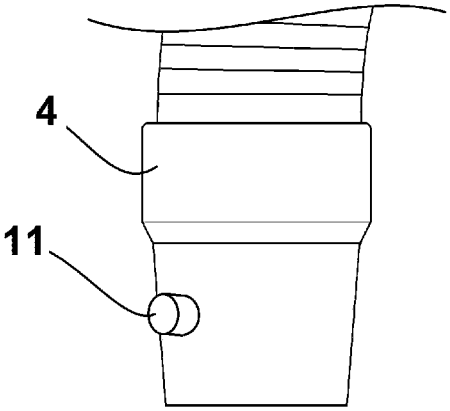
FIGS. 9A and 9B are side elevation views of one of the many alternative embodiment of the invention, illustrating an interlocking selectably engageable hose/head joint. As shown, a hose cuff (see FIG. 9A) includes a post 11, and that piece is inserted into a central vacuum hole as shown in FIG. 9B and interfits into a locking groove 12. Persons of ordinary skill in the art will understand that the parts can be reversed—the vacuum hole could have the post 11 and the hose cuff have the groove 12.
Figure 9B:
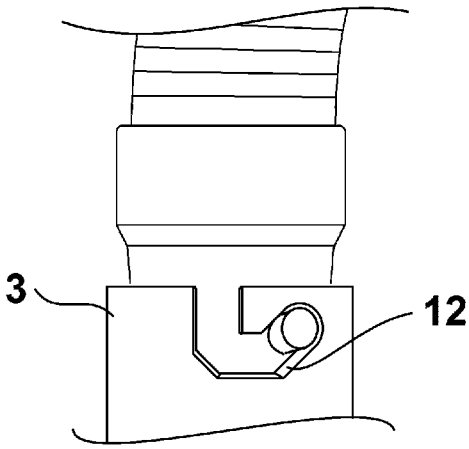

As used within the attached drawings, the following numbers refer generally to the following elements discussed herein:

1. Swimming Pool Vacuum Head
2. Swimming Pool Vacuum Hose
3. Central opening on vacuum head
4. Cuff on vacuum hose
5. Interlocking feature on vacuum head (i.e. protruding lip adjacent to edge of central opening)
6. Interlocking device (i.e. clip) on vacuum hose cuff.
6*a*: Spring type of element that enables clip to "grab" the lip 5.
6*b*: Head of clip, having a radially inwardly directed 'hook' or detent that operably engages with radially-external detent or lip 5 formed or provided on the mating element of the hose/head joint.
7. Keying element on hose cuff (i.e. protrusion designed to mate with cavity inside of central opening of vacuum head.
8. Flared component (in this case, adjustable).
9. Pin on which clip element rocks so a user can "lock/unlock" the clip around lip 5 that is formed on the other mating element of the joint. The curved arrow to the left of FIG. 1A illustrates this preferred rocking action to "engage/disengage" the hose and head from each other.
10. Upward protrusions or ridges positioned between the wheels on the vacuum head and extend the width of the vacuum head.
11. Post if a hose cuff.
12. Locking groove.
13. Handle that can be attached to a telescopic pole to enable a user to manipulate the head and vacuum the bottom (underwater surfaces) of a pool while standing above the pool on the pool deck.

Certain embodiments of the invention (with or without the flared/urging elements discussed elsewhere herein) preferably provide a vacuum head and hose with one or more interlocking features that help prevent the unintentional separation of the hose from the vacuum head. This can be useful to address many of the problems discussed above, and to help extend the useful life of a desired/required "snug fit" between the hose and head of a vacuum system.

In one example, and as illustrated in FIGS. 1/1A/1B, one or more clip elements 6 is molded into and/or attached onto the vacuum head near or adjacent to the central vacuum hole. The precise number, materials, shape, dimensions, position, and other properties of the clip element(s) can be selected depending upon a number of factors, including the parameters of the underwater surfaces to be cleaned. In any case, preferably the retaining/engaging structures are sufficient to retain the desired engagement between the vacuum hose and the vacuum head, but are relatively easy for a user to actuate when the user desires to disengage the head/hose from each other. As indicated, preferably the physical features of the hose cuff are such as to provide a temporarily interlock with the clip element that can be released easily when separation is desired.

Persons of ordinary skill in the art will understand that any of a wide variety of "releasably locking" structures can be used to provide the desired enhanced engagement between the hose and head. By way of example and not by way of limitation, any "quick connect" tubing engagements can be used, such as cooperating structures formed on the male/female elements that are engaged by inserting the male into the female and rotating the elements to engage those cooperating structures in a friction and/or interference fit with each other. Persons of ordinary skill in the art will understand that the selection of any particular embodiment of enhanced engagement apparatus between the hose and head will depend on a number of factors, which typically will be balanced by a product designer, user, and/or other person(s) involved in making and/or using the particular embodiment of the invention.

Another embodiment provides for a locking feature on a hose cuff (i.e. a spring loaded clip) that automatically 'snaps' together with a corresponding feature on a vacuum head.

Still another embodiment provides for the locking feature (i.e. spring loaded clip) being mounted on the vacuum head, with a corresponding locking feature (i.e. a ridge) on the hose cuff.

Still another embodiment provides a vacuum head and hose with interlocking features that prevent the unintentional separation of the hose from the vacuum head. A clip element molded into or attached onto the hose cuff near or adjacent to where the cuff joins the vacuum head's central hole retains the hose on the vacuum head. Physical features of the hose vacuum head temporarily interlock with the hose cuff's clip element and can be released easily when separation is desired.

A further embodiment of my invention provides a vacuum head and hose with a plurality of interlocking features between the vacuum head and hose.

Yet another embodiment of my invention provides a vacuum head for cleaning swimming pools, the vacuum head further having a central hole to receive a vacuum hose, a vacuum hose with cuffs on its ends, and both the vacuum head and at least one hose cuff having interlocking/mating features that prevent the hose from unintentionally separating from the vacuum head.

Still another embodiment of my invention provides a vacuum for cleaning swimming pools, in which a vacuum head and hose are tethered or otherwise held together to prevent unintentional separation. An additional component such as a strap, cord or loop holds the vacuum head and hose together in connected positions Another embodiment provides for the central hole of a vacuum head (which is normally round/circular in shape) having at least one additional feature/side/indentation/protrusion that is keyed with at least one corresponding feature/side/indentation/protrusion to prevent the cuff from rotating within the vacuum head's central hole.

A further embodiment includes a vacuum head with a central hole that a) keys with a correspondingly shaped hose cuff, and b) further includes at least one interlocking feature between the vacuum head and hose.

A further embodiment includes a vacuum head with a central hole that a) keys with a correspondingly shaped hose cuff, and b) further includes at least one interlocking feature between the vacuum head and hose.

Yet another preferred embodiment includes a vacuum head with a central hole that a) keys with a correspondingly shaped hose cuff, and further includes at least one flared feature to urge debris under the vacuum head so that it may be sucked into the hose.

Other embodiments include a vacuum for cleaning swimming pools in which any array/combination of flares described above is also used with any hose-to-body locking device described above, and/or a cuff that is keyed to the central hole.

In certain embodiments of the invention, and independently of whether the embodiment includes any improved interlocking structure between the head and hose as discussed above, the vacuum head 1 preferably has one or more flared or otherwise extending features along various portions of its body, and the flared and/or extending features are designed, shaped, sized, and positioned to urge targeted debris (including large leaves, etc. as mentioned above) under the vacuum head's body element so that that debris may then be pulled by suction into the vacuum hose and subsequently caught in a strainer basket or filter (and thereby be removed from the pool). The flared and/or extending features may further be designed to extend upwards and away from the pool bottom so as to enable the vacuum head to overtake large debris such as leaves, twigs, etc., or otherwise prevent or make it less likely that those large pieces of debris will float "over" the vacuum head, be pushed away from the head, etc.

In another embodiment (not shown), the flared and/or extending features are permanently molded within and/or as part of the body of the vacuum head. Persons of ordinary skill in the art will further understand that the flares can be operably attached to the body by any of a wide range of suitable methods, including gluing, tacking, snap-fit, interference fits, etc.

Another embodiment of my invention preferably includes flares that allow the vacuum head to maintain its flexibility (so that the confronting surface of the head 1 can flex and better approach the shape of the underwater surface to be cleaned, thereby better positioning the vacuum hole nearer to the debris to be removed). Among the many ways this can be achieved, a flare can be mounted so that there is a single contact point between it and the vacuum's body, the flares can have slots, the flares can be made of rubbery/flexible material, etc.

In yet another preferred embodiment, the flared and/or extending features are separate components and may be removed and/or reattached to the body of the vacuum head. Such removable/replaceable components are provided with flares of different sizes and shapes and enable a user to choose which flare/extended feature that is most appropriate for the cleaning conditions. Persons of ordinary skill in the art also will understand that such modular embodiments also permit ready repair of broken or damaged flares, and allow the user to customize the assembly for any given situation and/or needs.

Another embodiment provides for mounted flares to be adjusted without removing them from the vacuum head (i.e. a flare may have an extended portion with a slot or groove and be locked into a desired position with a wing nut, snap, or other temporary locking/engagement device).

Another embodiment provides for a mounting feature or features molded into the vacuum body (i.e. a threaded post onto which a flare, slotted or otherwise, can be attached/adjusted with a wing nut, pin, or other temporary locking/engagement device).

In still another embodiment, the vacuum head has a combination of permanent and removable/replaceable flared/extending components.

The present invention is described herein with reference to the accompanying Figures, which serve as illustrations of some of the many embodiments in which the invention may be practiced. Subject to the context and other factors (including for example the understanding of persons of ordinary skill in the arts relevant to the inventions), generally in those Figures and references similar reference numerals refer to similar or identical elements throughout this description.

Those Figures and references, and the other terminology used in these descriptions, are not intended to be interpreted in any limited or restrictive manner, simply because it is being utilized in conjunction with a detailed description of certain embodiments of the invention. Furthermore, various embodiments of the invention (whether or not specifically described herein) may include one or more of the novel features disclosed herein, no single one of which (a) is necessarily solely responsible for any particular desirable attribute(s) of the inventions or (b) is essential to practicing the inventions described.

For the purpose of summarizing the invention, certain objects and advantages have been described herein. It is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

The apparatus and methods of the invention have been described with some particularity, but the specific designs, constructions, and steps disclosed are not to be taken as delimiting of the invention. A wide range of modifications and alternative structures and steps for practicing the invention will make themselves apparent to those of ordinary skill in the art, all of which will not depart from the essence of the invention, and all such changes and modifications are intended to be encompassed within the appended claims.

Although the methods or processes of the present invention are illustrated herein with steps occurring in a certain order, the specific order of the steps, or any continuation or interruption between steps, is not required.

What is claimed is:

1. Apparatus for cleaning an underwater surface of a pool, including: a vacuum head having a body with a bottom surface and having a vacuum hole positioned within said body, said vacuum head having supporting wheels mounted thereon and configured to enable said vacuum head to roll on said underwater pool surface during use so that said vacuum hole is brought into proximity to said underwater pool surface during use; said vacuum head including at least one urging element, said urging element having a first portion mounted to said body and a second portion projecting outward from said body having an extended lower surface, said urging element configured to encourage debris to feed under said lower surface and under said bottom surface of said body toward said vacuum hole as said vacuum head is passed over said underwater pool surface, said projecting second portion of said urging element generally adjacent at least one of said wheels but spaced from and not contacting any of said wheels and any structure by which said wheels are mounted to said body.

2. The apparatus of claim 1, said urging element having a distal edge furthest from said body, said distal edge positioned further from said underwater surface than the remainder of said urging element.

3. The apparatus of claim 1, said urging element forming an at least generally concave shape, a lowermost portion of said concave shape connected to said body of said vacuum head, said concave shape extending generally upward from said connected portion to said outside edges.

4. The apparatus of claim 3, wherein said vacuum head includes a female opening for receiving a male hose cuff element on said vacuum hose.

5. The apparatus of claim 1, wherein said urging element is manufactured from a flexible material.

6. The apparatus of claim 1 or claim 5, in which said urging element is attached to said vacuum head so that there is a single contact point between said urging element and said vacuum head.

7. The apparatus of claim 1, wherein said at least one flared urging element is removably attached to said body.

8. The apparatus of claim 7, wherein said at least one flared urging element is adjustable without being removed from said body, said adjustability of said flared urging element provided by a slot formed in an attached portion of said flared urging element which engages with a temporary engagement device.

9. The apparatus of claim 1, in which said body includes at least two laterally extending stiffeners generally aligned between a pair of said wheels, and a generally flexible surface extending between and connecting said adjacent lateral stiffeners, said urging element affixed to said generally flexible surface between said stiffeners at a single contact point, and said urging element having side edges extending toward but not against the adjacent lateral stiffeners, so that the urging element has minimal reduction of deflection permitted by the generally flexible surface.

10. The apparatus of claim 1, wherein said at least one flared element is permanently molded on said body.

11. The apparatus of claim 1, further including at least one slot formed in said at least one flared urging element.

12. The apparatus of claim 1, wherein said at least one flared urging element is tapered.

13. Apparatus for underwater vacuum cleaning, including: a flexible vacuum head having a body with a bottom surface and having a vacuum hole positioned within said body, said vacuum head including at least a pair of wheels and wheel mounting elements operatively affixing said wheels to said body; and at least one urging element having a first portion attached to said body adjacent at least one of said wheels, said urging element having a second portion which projects outward from said body and includes an extended lower surface, said second portion which projects being spaced from any contact with any of said wheels and any of said wheel mounting elements, said urging element configured to encourage debris to feed under said lower surface and under said bottom surface of said body toward said vacuum hole as said vacuum head is passed over said underwater pool surface.

14. A method of cleaning an underwater surface of a pool, including the steps of: providing a flexible vacuum head having a body with a bottom surface and having a vacuum hole positioned within said body, said vacuum head including at least a pair of wheels and wheel mounting elements operatively affixing said wheels to said body; and at least one urging element having an attachment portion wherein said urging element is attached to said body adjacent at least one of said wheels, said urging element further including a projecting portion wherein said urging element projects outward from said body and has an extended lower surface, said projecting portion of said urging element being spaced from any contact with any of said wheels and any of said wheel mounting elements, said urging element configured to encourage debris to feed under said lower surface and under said bottom surface of said body toward said vacuum hole as said vacuum head is passed over said underwater pool surface; manipulating that apparatus over said underwater surface to be cleaned.

15. The method of claim 14, wherein said vacuum head has one or more stiffening webs formed thereon to provide a desired degree of structural support and stiffness to said body while maintaining a desired degree of flexibility within said body.

16. The apparatus of claim 1 or claim 13, wherein said vacuum head has one or more stiffening webs formed thereon to provide a desired degree of structural support and stiffness to said body while maintaining a desired degree of flexibility within said body.

17. The apparatus of claim 16, in which said urging element is affixed at a plurality of contact points.

18. The apparatus of claim 16, further including at least one slot formed in said at least one urging element.

19. The apparatus of claim 16, wherein said at least one urging element is tapered.

20. A method of cleaning an underwater surface of a pool, including the steps of: providing a vacuum head having a body with a bottom surface and having a vacuum hole positioned within said body, said vacuum head having supporting wheels mounted thereon and configured to enable said vacuum head to roll on said underwater pool surface during use so that said vacuum hole is brought into proximity to said underwater pool surface during use; said vacuum head including at least one urging element mounted to said body and projecting outward from said body having an extended lower surface, said urging element configured to encourage debris to feed under said lower surface and under said lower bottom surface of said body toward said vacuum hole as said vacuum head is passed over said underwater pool surface, said urging element generally adjacent at least one of said wheels but spaced from and not contacting any of said wheels and any structure by which said wheels are mounted to said body; manipulating that apparatus over said underwater surface to be cleaned.

21. Apparatus for connection to a vacuum hose for vacuum cleaning of debris from an underwater surface, the apparatus comprising: a vacuum head comprising a flat rectangular body element, a hose connector, at least one debris urging element, and a handle attachment portion; wherein the flat rectangular body element comprises a top surface, a bottom surface, a front face, a rear face, and a central hole through the top surface and bottom surface in fluid communication with the hose connector, the flat rectangular body configured be flexible and to maintain a gap between the bottom surface and the underwater surface; wherein the hose connector attached to the top surface of the flat rectangular body element and is configured with at least one engaging element to releasably interlock with the vacuum hose to prevent unintentional separation; wherein the debris urging element comprises a mounting end and a flared urging portion, wherein the mounting end of the debris urging element is mounted to the flat rectangular body element such that a distal edge of the flared urging portion of the debris urging element extends a distance outward from either the front face or the rear face of the flat rectangular body element, wherein the flared urging portion of the debris urging element is shaped to extend upward and away from the top surface such that the distal edge is positioned further from the underwater surface than the remainder of the debris urging element; wherein the vacuum head is configured such that, when the vacuum head is placed and moved in contact with the underwater surface, debris is encouraged by the debris urging element to migrate under the flat rectangular body element, proceed toward and through the central hole, and be captured by the vacuum hose.

22. The apparatus of claim 21, wherein the flared urging portion of the debris urging element comprises an upward sloping at least generally concave shape.

23. The apparatus of claim 21, wherein the width of the mounting end of the debris urging element tapers outward to form the flared urging portion.

24. The apparatus of claim 21, wherein the vacuum head comprises at least a pair of wheels connected to the flat rectangular body element to maintain the gap between the bottom surface and the underwater surface.

25. The apparatus of claim 21, wherein the debris urging element is removably mounted to the flat rectangular body element.

26. The apparatus of claim 25, wherein the debris urging element is slidably mounted to the flat rectangular body element allowing the distance that the distal edge of the flared urging portion of the debris urging element extends outward from either the front face or the rear face of the flat rectangular body element to be adjustable without being removed from the vacuum head.

27. The apparatus of claim 26, wherein the debris urging element comprises a slot formed in the mounting end which allows the debris urging element to be slidably mounted to the flat rectangular body element.

28. The apparatus of claim 21, wherein the debris urging element is integrally attached to the flat rectangular body element.

29. The apparatus of claim 21, wherein the hose connector includes an opening for receiving a male hose cuff element on the vacuum hose.

30. The apparatus of claim 29, wherein the hose connector includes a keyed opening for receiving a male hose cuff element with a corresponding keyed feature on the vacuum hose to prevent rotation therebetween.

31. The apparatus of claim 21, wherein the engaging element comprises at least one spring loaded clip configured to engage a locking feature on a male hose cuff element on the vacuum hose.

32. The apparatus of claim 21, wherein the engaging element is a locking feature configured to engage at least one spring loaded clip on a male hose cuff element on the vacuum hose.

33. The apparatus of claim 21, wherein the engaging element is a locking groove configured to engage a protrusion on a male hose cuff element on the vacuum hose.

34. The apparatus of claim 21, wherein the engaging element is a protrusion configured to engage a locking groove on a male hose cuff element on the vacuum hose.

35. Apparatus for connection to a vacuum hose for vacuum cleaning of debris from an underwater surface, the apparatus comprising: a vacuum head comprising a body element, a hose connector, at least one debris urging element, and a handle attachment portion; wherein the body element comprises a top surface, a bottom surface, a front face, a rear face, and a hole through the top surface and bottom surface in fluid communication with the hose connector, the body configured be flexible and to maintain a gap between the bottom surface and the underwater surface; wherein the debris urging element comprises a mounting portion and a flared urging portion, wherein the mounting portion of the debris urging element is mounted to the body element such that a distal edge of the flared urging portion of the debris urging element extends a distance outward from either the front face or the rear face of the body element, wherein the flared urging portion of the debris urging element is shaped to extend upward and away from the top surface such that the distal edge is positioned further from the underwater surface than the remainder of the debris urging element; wherein the vacuum head is configured such that, when the vacuum head is placed and moved in contact with the underwater surface, debris is encouraged by the debris urging element to migrate under the body element, proceed toward and through the hole, and be captured by the vacuum hose.

* * * * *